US005463178A

United States Patent [19]

Suzuki et al.

[11] Patent Number: 5,463,178

[45] Date of Patent: Oct. 31, 1995

[54] RECORDING SHEET AND PROCESS FOR ITS PRODUCTION

[75] Inventors: Shinichi Suzuki; Hitoshi Kijimuta, both of Yokohama, Japan

[73] Assignee: Asahi Glass Company Ltd., Tokyo, Japan

[21] Appl. No.: 275,525

[22] Filed: Jul. 15, 1994

[30] Foreign Application Priority Data

Jul. 16, 1993 [JP] Japan ..... 5-198995

[51] Int. Cl.[6] ..... B41M 5/00; B41M 1/36

[52] U.S. Cl. ..... 428/216; 427/146; 428/195; 428/206; 428/318.4; 428/331

[58] Field of Search ..... 428/195, 304.4, 428/323, 329, 331, 411.1, 688, 914, 206, 214–216, 318.4; 427/146

[56] References Cited

U.S. PATENT DOCUMENTS

| | | | |
|---|---|---|---|
| 5,104,730 | 4/1992 | Misuda et al. | 428/195 |
| 5,264,275 | 11/1993 | Misuda et al. | 428/195 |
| 5,275,867 | 1/1994 | Misuda et al. | 428/195 |

OTHER PUBLICATIONS

Database WPI, Derwent Publications Ltd., AM 93 080019, JP–A–05 024336, Feb. 2, 1993.

*Primary Examiner*—Pamela R. Schwartz

*Attorney, Agent, or Firm*—Oblon, Spivak, McClelland, Maier, & Neustadt

[57] ABSTRACT

A recoding sheet comprising a substrate, a porous layer of pseudo-boehmite having a thickness of from 10 to 100 μm formed on the substrate and a layer of silica gel having a thickness of from 0.1 to 30 μm formed on the porous layer of pseudo-boehmite.

11 Claims, No Drawings

RECORDING SHEET AND PROCESS FOR ITS PRODUCTION

The present invention relates to a recording sheet and a process for its production.

In recent years, along with wide spread use of electron still cameras or computers, technology for hard copies has rapidly been developed to record the images on paper sheets or the like. The ultimate goal of such hard copies is silver halide photography, and especially, it is an object of the development to bring the color reproduction, image density, gloss, weather resistance, etc. as close as those of silver halide photography. For the recording system of hard copies, not only a method of directly photographing a display on which an image is shown by silver halide photography, but also various systems such as a sublimation type thermal transfer system, an ink jet system and an electrostatic transfer system, are known.

Ink jet printers have been widely used in recent years, since full coloring is thereby easy, and printing noise is little. The ink jet system is designed to eject ink droplets from nozzles at a high speed to the recording sheet, and the ink contains a large amount of a solvent. Therefore, the recording sheet for an ink jet printer is required to quickly absorb the ink and yet have an excellent color-forming property. For example, a recording sheet is known which has a porous layer of alumina hydrate formed on a substrate (U.S. Pat. No. 5,104,730 and EP 524616A).

However, when the porous layer of alumina hydrate provided on a substrate is in contact with something sharp, it is susceptible to scratching. It is an object of the present invention to provide a recording sheet excellent in scratch resistance.

The present invention provides a recoding sheet comprising a substrate, a porous layer of pseudo-boehmite having a thickness of from 10 to 100 μm formed on the substrate and a layer of silica gel having a thickness of from 0.1 to 30 μm formed on the porous layer of pseudo-boehmite.

Now, the present invention will be described in detail with reference to the preferred embodiments.

The porous layer of pseudo-boehmite is preferably a colloidal aggregate of boehmite crystals ($Al_2O_3.nH_2O$, n=1 to 1.5). It preferably contains an organic binder component. In the recording sheet, the boehmite crystals are preferably orientated so that the b axis is vertical to the sheet surface, whereby high absorptivity and transparency will be imparted.

The porous layer of pseudo-boehmite preferably has a porous structure consisting essentially of pores with a radius of from 1 to 15 nm and having a pore volume of from 0.3 to 1.0 cc/g, whereby it will have adequate absorptivity and high transparency. Here, if the substrate and the adsorbent layer of a colorant are transparent, the recording sheet will be transparent. In the present invention, the pore radius distribution is measured by a nitrogen adsorption and desorption method.

As a method for forming the porous layer of pseudo-boehmite on the substrate, it is possible to employ, for example, a method whereby a binder is added to boehmite sol, which is then coated on the substrate by means of a roll coater, an air knife coater, a blade coater, a rod coater, a bar coater or a comma coater, followed by drying. As the binder, an organic substance such as starch or its modified product, a polyvinyl alcohol or its modified product, a SBR latex, a NBR latex, carboxymethyl cellulose, hydroxymethyl cellulose or polyvinyl pyrrolidone, may be used. The binder is preferably used in an amount of from 5 to 50 wt % of the pseudo-boehmite. If the amount of the binder is less than 5 wt %, the strength of the porous layer of pseudo-boehmite tends to be inadequate. On the other hand, if it exceeds 50 wt %, the adsorptivity for a colorant tends to be inadequate.

In the present invention, the substrate is not particularly limited, and various types may be employed. Specifically, various plastic sheets including sheets of e.g. a polyester resin such as polyethylene terephthalate, a polycarbonate resin and a fluorine resin such as ETFE, or paper materials may preferably be employed. In the case of a recording sheet for an overhead projector, the substrate is required to be transparent. However, an opaque substrate may also be employed. Further, for the purpose of improving the adhesive strength of colorant adsorbent layer, it is possible to apply corona discharge treatment or undercoating treatment.

In the present invention, a layer of silica gel is formed on the porous layer of pseudo-boehmite. The silica gel layer is preferred to have a structure such that spherical primary particles of silica are linked together, and powder of secondary particle are not contained in the layer. If the powder of secondary particle of silica are contained, the transparency of the coated layer tends to be impaired, and the mechanical strength of the silica gel layer tends to be inadequate, whereby the protecting effect of the pseudo-boehmite layer tends to be inadequate. The Silica gel layer can be formed by adding a binder to silica sol, followed by coating the mixture. As the silica sol, it is preferred employ the one having an average particle diameter of from 10 to 90 nm and a solid content concentration of from 1 to 20 wt %.

As the binder, the same binder as used for forming the porous layer of pseudo-boehmite may be employed. However, it is particularly preferred to employ a silanol-containing vinyl alcohol copolymer. The binder is used preferably in an amount of from 1 to 30 wt % relative to the solid content of the silica sol (as calculated as $SiO_2$). If the amount of the binder is less than 1 wt %, the mechanical strength of the silica gel layer tends to be inadequate, whereby the protecting effect of the pseudo-boehmite layer tends to be inadequate. On the other hand, if the amount of the binder exceeds 30 wt %, the ink absorptivity tends to be inadequate, whereby ink droplets are likely to join to one another on the surface of the recording sheet and printed image may be deformed. This phenomenon is generally called "beading".

By coating the coating fluid on the porous layer of pseudo-boehmite, followed by drying, a layer of silica gel can be formed. The thickness of this silica gel layer is preferably from 0.1 to 30 μm. If the thickness of the silica gel layer is less than 0.1 μm, the protecting effect of the porous layer of pseudo-boehmite tends to be inadequate, whereby scratch resistance tends to be inadequate. If the thickness of the silica gel layer is 30 μm, the transparency of the coated layer tends to be impaired, and the ink absorptivity tends to be inadequate, whereby beading is likely to result. More preferably, the thickness of the silica gel layer is from 0.1 to 10 μm. The mechanism for the improvement of scratch resistance by providing a silica gel layer in the present invention, is not clearly understood. However, when the coated surface of the recording sheet of the present invention is inspected by a scanning electron microscope, it is observed that the silica gel layer is formed on the surface of the pseudo-boehmite layer in a state where spherical primary particles of silica are regularly aligned. Accordingly, it is considered that smoothness of the surface of the coated layer is improved, whereby the lubricating property is imparted, which in turn contributes to the improvement of the scratch resistance.

Further, the silica gel layer provides an additional effect of improving the gloss of the recording sheet and contributes to the improvement of the image quality.

Now, the present invention will be described in further detail with reference to Examples. However, it should be understood that the present invention is by no means restricted to such specific Examples.

EXAMPLE 1

Using a polyvinyl alcohol (saponification degree: 99.8%, polymerization degree: 4000) and a boehmite sol prepared by hydrolysis-peptization of aluminum isopropoxide, a coating fluid having a total solid content concentration of 15 wt % was prepared in which the solid content of polyvinyl alcohol to the solid content of boehmite was 11 wt %. This coating fluid was coated on a polyethylene terephthalate film having a thickness of 100 μm by means of a bar coater so that the thickness of the coated layer after drying would be 30 μm, followed by drying to form a layer of pseudo-boehmite. Further, a silica sol coating fluid having a solid content of 5 wt % (R-1130/$SiO_2$=0.1) comprising a silica sol having a primary particle size of from 35 to 55 nm and a silanol containing polyvinyl alcohol copolymer (R-polymer R-1130, tradename, manufactured by KURARAY CO., LTD.), was coated and dried so that the thickness of the silica gel layer would be 1 μm, followed by heat treatment at 140° C. to obtain a recording sheet.

This recording sheet was observed by a scanning electron microscope, whereby the silica gel layer which was formed on the surface of the pseudo-boehmite layer had a structure that spherical primary particles of silica are regularly aligned.

This recording sheet had a adequate absorptivity which permits recording by an ink jet printer, and its transparency was excellent. This recording sheet was subjected to an abrasion test for 100 times by pressing a cotton gauze under a load of 200 g by means of an abrasion tester (manufactured by Suga Shikenki K.K.), whereby no scratch mark was observed. The 60° specular glossiness of this recording sheet was 50%.

COMPARATIVE EXAMPLE

A recording sheet was prepared in the same manner as in Example 1 except that no silica gel layer was formed. This recording sheet was subjected to the same abrasion test, whereby scratch marks were observed. The 60° specular glossiness of this sheet was 40%.

The recording sheet of the present invention has high ink absorptivity and high colorant adsorptivity, and the abrasion resistance of the recording surface is excellent. Its gloss is also excellent. Thus, it is particularly suitable for use as a recording sheet for an ink jet printer.

We claim:

1. A recording sheet comprising a substrate, a porous layer of pseudo-boehmite having a thickness of from 10 to 100 μm formed on the substrate and a layer of silica gel having a thickness of from 0.1 to 30 μm formed as the outermost layer on the porous layer of pseudo-boehmite.

2. The recording sheet according to claim 1, wherein the layer of silica gel has a structure consisting essentially of spherical particles of silica which are linked together.

3. The recording sheet according to claim 2, wherein the diameter of the spherical particles of silica is from 10 to 90 nm.

4. The recording sheet according to claim 1, wherein the layer of silica gel contains a binder in an amount of from 1 to 30 wt % of the silica gel.

5. The recording sheet according to claim 1, wherein the porous layer of pseudo-boehmite has a porous structure consisting essentially of pores with a radius of from 1 to 15 nm and having a pore volume of from 0.3 to 1.0 cc/g.

6. The recording sheet according to claim 1, wherein the porous layer of pseudo-boehmite contains a binder in an amount of from 5 to 50 wt % of the pseudo-boehmite.

7. The recording sheet according to claim 1, which is a recording medium for an ink jet printer.

8. The recording sheet according to claim 1, consisting essentially of said substrate, porous layer and layer of silica gel.

9. A process for producing a recording sheet, which comprises forming a porous layer of pseudo-boehmite on a substrate, and coating thereon silica sol together with a binder, followed by drying to form a layer of silica gel.

10. The process for producing a recording sheet according to claim 9, wherein the average particle diameter of the silica sol is from 10 to 90 nm.

11. The process for producing a recording sheet according to claim 9, wherein the binder is from 1 to 30 wt % relative to the solid content of the silica sol.

* * * * *